US008292534B2

(12) United States Patent
Nakatani et al.

(10) Patent No.: US 8,292,534 B2
(45) Date of Patent: Oct. 23, 2012

(54) LIQUID APPLICATOR

(75) Inventors: Yasunori Nakatani, Nishinomiya (JP); Hiroshi Inoue, Higashiosaka (JP)

(73) Assignee: Sakura Color Products Corporation (JP)

( * ) Notice: Subject to any disclaimer, the term of this patent is extended or adjusted under 35 U.S.C. 154(b) by 866 days.

(21) Appl. No.: 11/922,274

(22) PCT Filed: Jun. 14, 2006

(86) PCT No.: PCT/JP2006/311930

§ 371 (c)(1),
(2), (4) Date: Dec. 14, 2007

(87) PCT Pub. No.: WO2006/134968

PCT Pub. Date: Dec. 21, 2006

(65) Prior Publication Data

US 2010/0014906 A1 Jan. 21, 2010

(30) Foreign Application Priority Data

Jun. 15, 2005 (JP) ..... 2005-175383

(51) Int. Cl.
*B43K 1/06* (2006.01)
*B43K 5/16* (2006.01)

(52) U.S. Cl. ..... 401/260; 401/259

(58) Field of Classification Search ..... 401/263, 401/264, 205, 206, 272, 273, 259–261, 270
See application file for complete search history.

(56) References Cited

U.S. PATENT DOCUMENTS

| | | | | | |
|---|---|---|---|---|---|
| 1,540,082 | A * | 6/1925 | Merrill | 401/260 |
| 2,008,454 | A * | 7/1935 | Klein | 401/260 |
| 2,045,926 | A * | 6/1936 | Reutter | 401/260 |
| 4,541,552 | A * | 9/1985 | Scheithauer | 401/260 |
| 4,543,005 | A * | 9/1985 | Kuboshima | 401/260 |
| 5,261,755 | A * | 11/1993 | Draper et al. | 401/264 |
| 5,846,011 | A * | 12/1998 | Bernstein et al. | 401/205 |
| 5,938,360 | A * | 8/1999 | Yen et al. | 401/206 |
| 6,135,659 | A * | 10/2000 | Ku | 401/264 |
| 6,287,037 | B1 * | 9/2001 | Hay | 401/273 |

* cited by examiner

*Primary Examiner* — David Walczak
*Assistant Examiner* — Jennifer C Chiang
(74) *Attorney, Agent, or Firm* — Wood, Phillips, Katz, Clark & Mortimer

(57) ABSTRACT

A liquid applicator adapted to prevent an application liquid from leaking or drying with a small biasing force. A tip unit for a liquid applicator of the present invention includes a tubular member and a valve member. The valve member is biased toward a distal end thereof by a biasing member so as to seal a distal opening portion of the tubular member. The distal opening portion includes a first tapered surface and a second tapered surface located at a proximal side of the first tapered surface. The first and the second tapered surfaces are in contact with a tapered area and a ring of the valve member, respectively, so as to seal the distal opening portion.

11 Claims, 9 Drawing Sheets

LIQUID APPLICATOR

BACKGROUND OF THE INVENTION

1. Field of the Invention

The present invention relates generally to a liquid applicator for applying an application liquid such as a correction fluid.

2. Background Art

A liquid applicator for applying an application liquid such as a correction fluid when needed has been conventionally used.

As such a liquid applicator, one provided with a liquid receptacle including a filled part having an opening and a valve body arranged at the opening of the liquid receptacle is used. The valve body is biased outwardly, with part of the valve body exposed outside of the opening.

Generally, the opening of the filled part is closed by the valve body so as to prevent an application liquid from leaking out or from drying, and in application, such closed condition is released by pressing the applicator onto an object to which the liquid is to be applied so that the liquid in the liquid receptacle is discharged out.

An applicator of such a valve type is disclosed in the patent document 1. The valve-type applicator is adapted to apply a larger quantity of application liquid than a ball-type applicator.

Patent document 1: JP 1-148776U

SUMMARY OF THE INVENTION

Problem to be Solved by the Invention

In such an applicator, a higher biasing force applied to a valve body more certainly prevents an application liquid from leaking when the applicator is not used. However, when the applicator is used, a stronger force is required to press the applicator onto the object. Therefore, a liquid applicator adapted to certainly prevent an application liquid from leaking with a small biasing force has been desired.

Further, the application liquid discharged when the applicator is used is adhered to outside of the valve body, the adhered liquid solidifying as time passes. The adhered and solidified product might impede discharging of the liquid, resulting in insufficient application or incapable discharging of the liquid.

Therefore, it is an object of the present invention to provide a liquid applicator adapted to prevent an application liquid from leaking or drying with a small biasing force.

Means to Solve the Problem

A first form of liquid applicator, for achieving the above-mentioned object is has a tip unit for a liquid applicator including a tubular member having therein a through-bore and a valve member arranged within and being movable in the through-bore, the through-bore having a distal opening and a proximal opening, wherein the tubular member and the valve member each has a proximal end and a distal end, wherein the valve member is accompanied with a biasing member, so as to be biased toward the distal end of the tubular member to be in close contact with and to seal the distal opening, with part of the valve member protruding from the distal opening of the through-bore, wherein the liquid applicator has a reservoir for containing an application liquid, the reservoir being communicated with the proximal opening of the through-bore of the tubular member, so that the application liquid is applied to an object by pressing the part of the valve member protruding from the distal opening against the object to move the valve member back so as to release sealing of the distal opening, wherein the distal opening has a first tapered surface and a second tapered surface formed at a proximal side of the first tapered surface, the first and the second surfaces each being of an inwardly-facing tapered shape with its diameter decreasing toward the distal end, the second tapered surface having a taper angle larger than that of the first tapered surface, and wherein the valve member includes a main body having a tapered area with an inclined surface and a ring located at a proximal side of the tapered area, the ring and the second tapered surface being in close contact with each other so as to seal the distal opening.

With the first form of liquid applicator, a ring of a valve member is brought into close contact with a second tapered surface so as to seal a distal opening of a through-bore of a tubular member. The second tapered surface has an inwardly-facing tapered shape in which its diameter decreases toward the distal end thereof and the valve member is biased toward the distal end. Thus, when the ring has a close contact with the second tapered surface, the ring is pushed inwardly, so as to be sandwiched between the second tapered surface and a main body of the tubular member. That ensures close contact with each other. That is why a relatively small biasing force prevents an application liquid from leaking or drying. On the other hand, when the applicator is used, pushing part of the valve member protruding from the distal opening increases a distance between a first tapered surface and an inclined surface, thereby ensuring application of the liquid.

In a second form of liquid applicator, the tapered area of the first form is conical in shape.

With the second form, the tapered area has a conical shape, so as to be easily processed and easily manufactured.

A third form of liquid applicator is made according to the first form, further wherein the tapered area has a taper angle having a difference of 10 degrees or less from the taper angle of the first tapered surface of the tubular member.

With the third form, since a difference between a taper angle of the tapered area and that of the first tapered surface of the tubular member is 10 degrees or less, so that a distance between the inclined surface of the tapered area and the first tapered surface is decreased when the applicator is not used and that the distance is easily increased by movement of the valve member when the applicator is used.

A fourth form of liquid applicator is made according to the first form, further wherein the tapered area has a taper angle substantially equal to the taper angle of the first tapered surface of the tubular member.

With the fourth form, the taper angle of the tapered area is substantially equal to that of the first tapered surface, so that the distance between the inclined surface of the tapered area and the first tapered surface is further decreased when the applicator is not used and that the distance is increased more easily by movement of the valve member when the applicator is used.

A fifth form of liquid applicator is made according to the first form, further wherein the main body has a circumferential groove, with which the ring is engaged.

With the fifth form, the main body has a circumferential groove, with which the ring is engaged, so that the ring is easily fixed to the main body.

A sixth form of liquid applicator is made according to the fifth form, further wherein the circumferential groove has a shape conformed to a shape of an inner side of the ring.

With the sixth form, the shape of the circumferential groove is conformed to the shape of an inner side of the ring, thereby ensuring that the ring is in contact with the groove more closely.

seventh form of liquid applicator is made according to the first form, further wherein the ring is made of an elastic body and is deformable, so as to be in close contact with the second tapered surface while changing degree of deformation in response to a distance between the first tapered surface and the inclined surface of the tapered area.

With the seventh form, the ring is made of an elastic body and is deformable, so as to be in close contact with the second tapered surface while changing degree of deformation in response to a distance between the first tapered surface and the inclined surface. That enables close contact of the ring with the second tapered surface, even if a solidified application liquid exists between the first tapered surface and the inclined surface. Further, the ring is pressed onto the main body, so that close contact of the ring with the main body ensures to fill a gap therebetween, preventing air passing and ink solidification. In particular, engagement of the ring with the circumferential groove allows filling the gap.

An eighth form of liquid applicator is made according to the first form, further wherein the biasing member is a helical compression spring, and wherein the valve member has a spring holding part having an outer diameter smaller than an inner diameter of coil of the biasing member at the proximal end of the valve member, so that the biasing member is positioned at the proximal end of the main body of the valve member with the spring holding part inserted in the biasing member.

With the eighth form, there is provided a spring holding part having an outer diameter smaller than an inner diameter of coil of the biasing member, which is a helical compression spring, at the proximal end of the valve member. Therefore, the biasing member is positioned at the proximal end of the main body of the valve member with the spring holding part inserted in the biasing member. That achieves easy assembly and prevents relative displacement of the biasing member and fluctuation of a biasing force caused from the displacement.

The taper angle of the first tapered surface in the first form of liquid applicator may be in a range within 10 to 120 degrees in a ninth form.

Advantageous Effect of the Invention

The liquid applicator of the present invention prevents an application liquid from leaking or drying with a small biasing force and discharges the liquid certainly even if a solidified application liquid is adhered to the applicator.

BRIEF DESCRIPTION OF THE DRAWINGS

FIG. 1A being an elevation view thereof, FIG. 1B being a top view thereof, and FIG. 1C being a partial cross section thereof;

FIG. 3A being an elevation view thereof, FIG. 3B being a cross section thereof, and FIG. 3C being is an enlarged cross section of a vicinity of a distal end thereof;

FIG. 5A being an elevation view of a main body, FIG. 5B being a bottom view of the main body, FIG. 5C being an elevation view of a ring, and FIG. 5D being a bottom view of the ring;

DESCRIPTION OF PREFERRED EMBODIMENTS

Figure 1B:
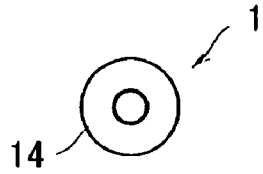
FIGS. 1A, 1B, and 1C are diagrams showing a liquid applicator of the present invention.
Figure 1A:
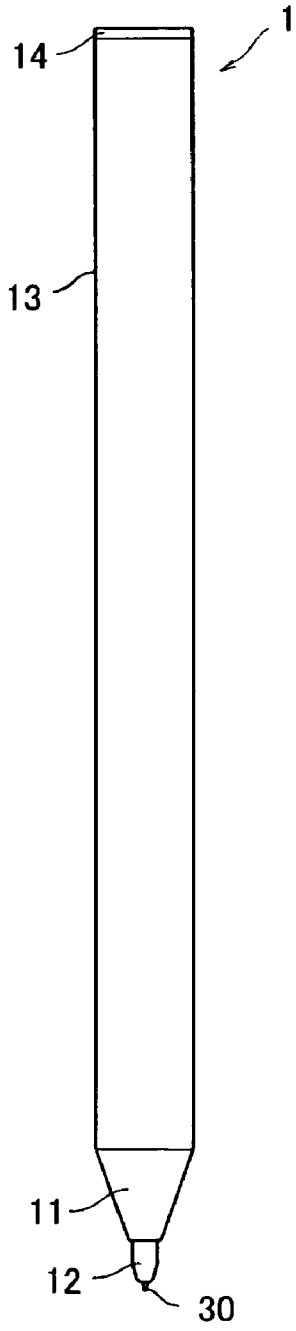
Figure 1C:
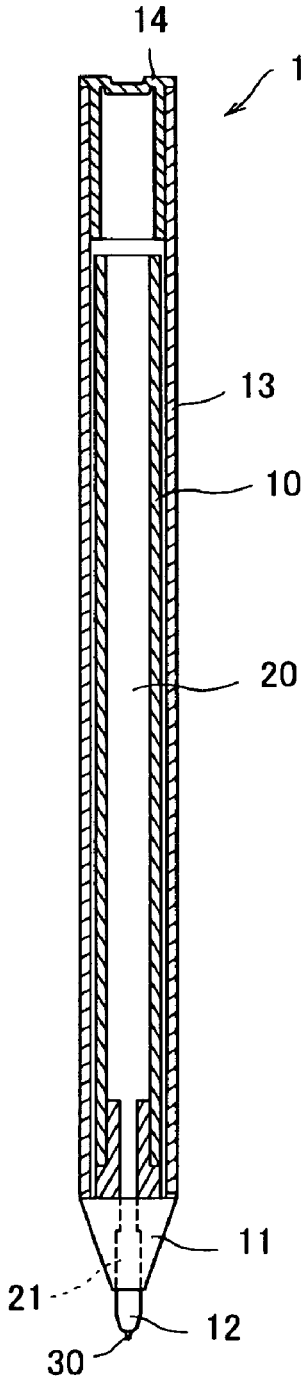
Figure 2:
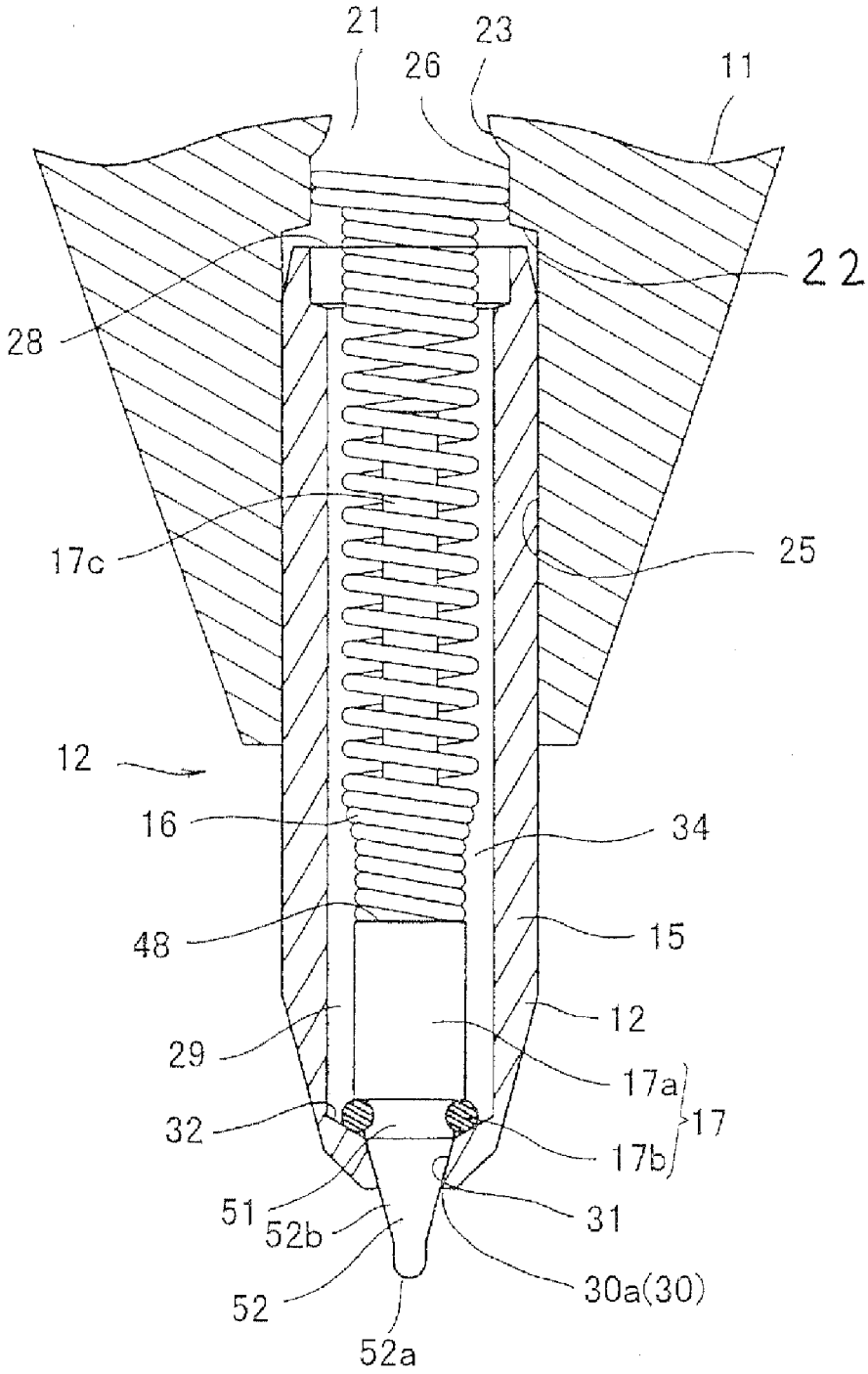
FIG. 2 is an enlarged cross section of a vicinity of a distal end of the liquid applicator shown in FIG. 1.
Figure 3A:
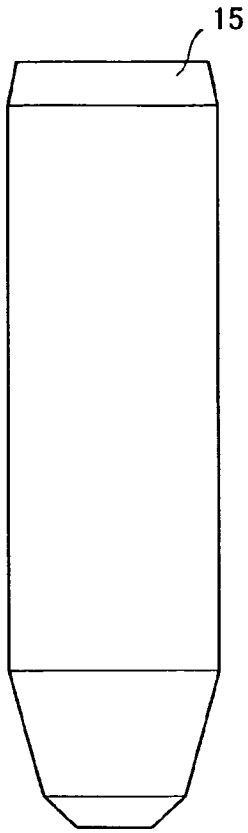
FIGS. 3A, 3B, and 3C are diagrams showing a tubular member.
Figure 3B:
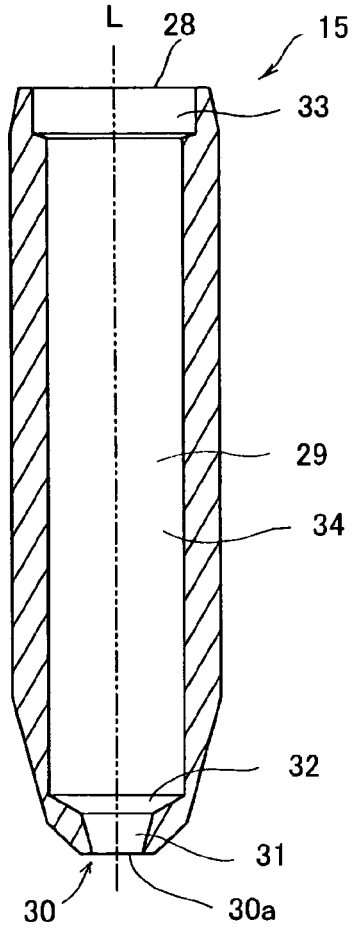
Figure 3C:
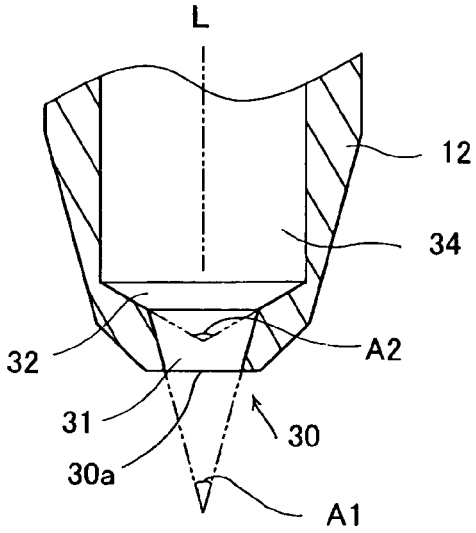
Figure 4:
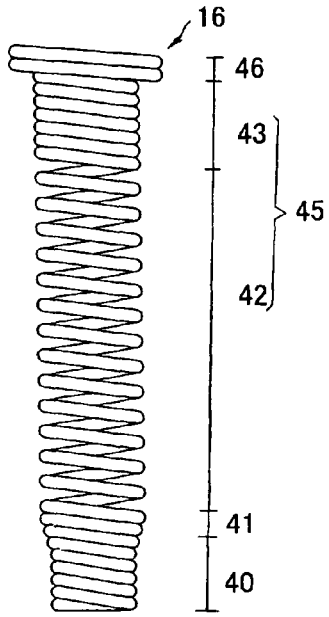
FIG. 4 is an elevation view of a biasing member.
Figure 5A:
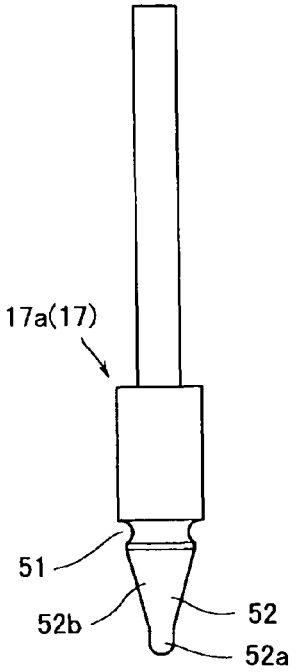
FIGS. 5A to 5D are diagrams showing a valve member.
Figure 5C:
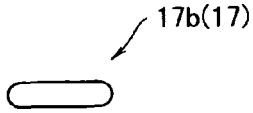
Figure 5B:
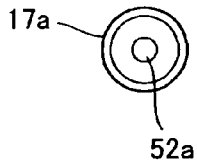
Figure 5D:
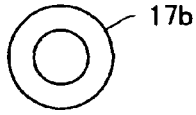
Figure 6:
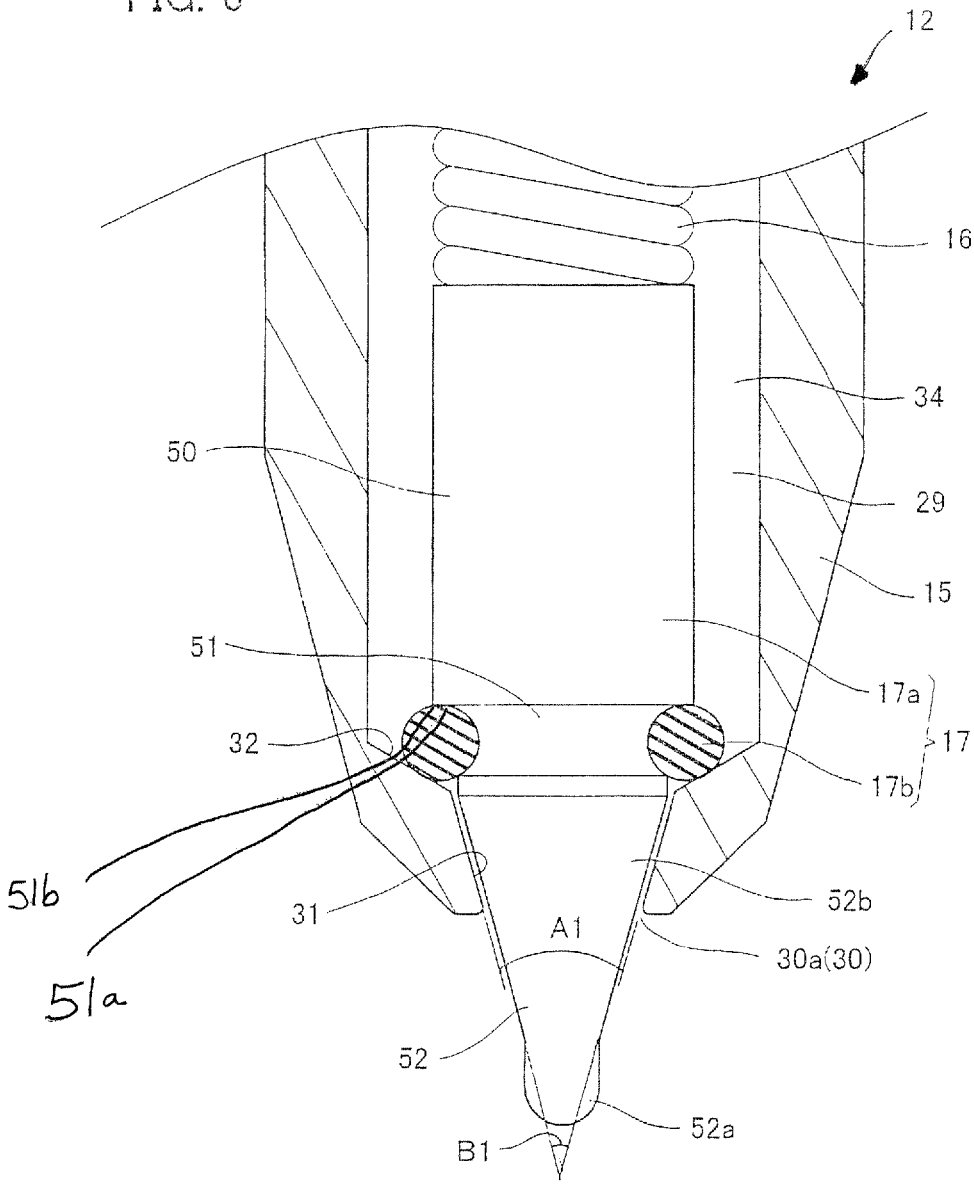
FIG. 6 is an enlarged cross section of a vicinity of a distal end of a tip unit for a liquid applicator.
Figure 7:
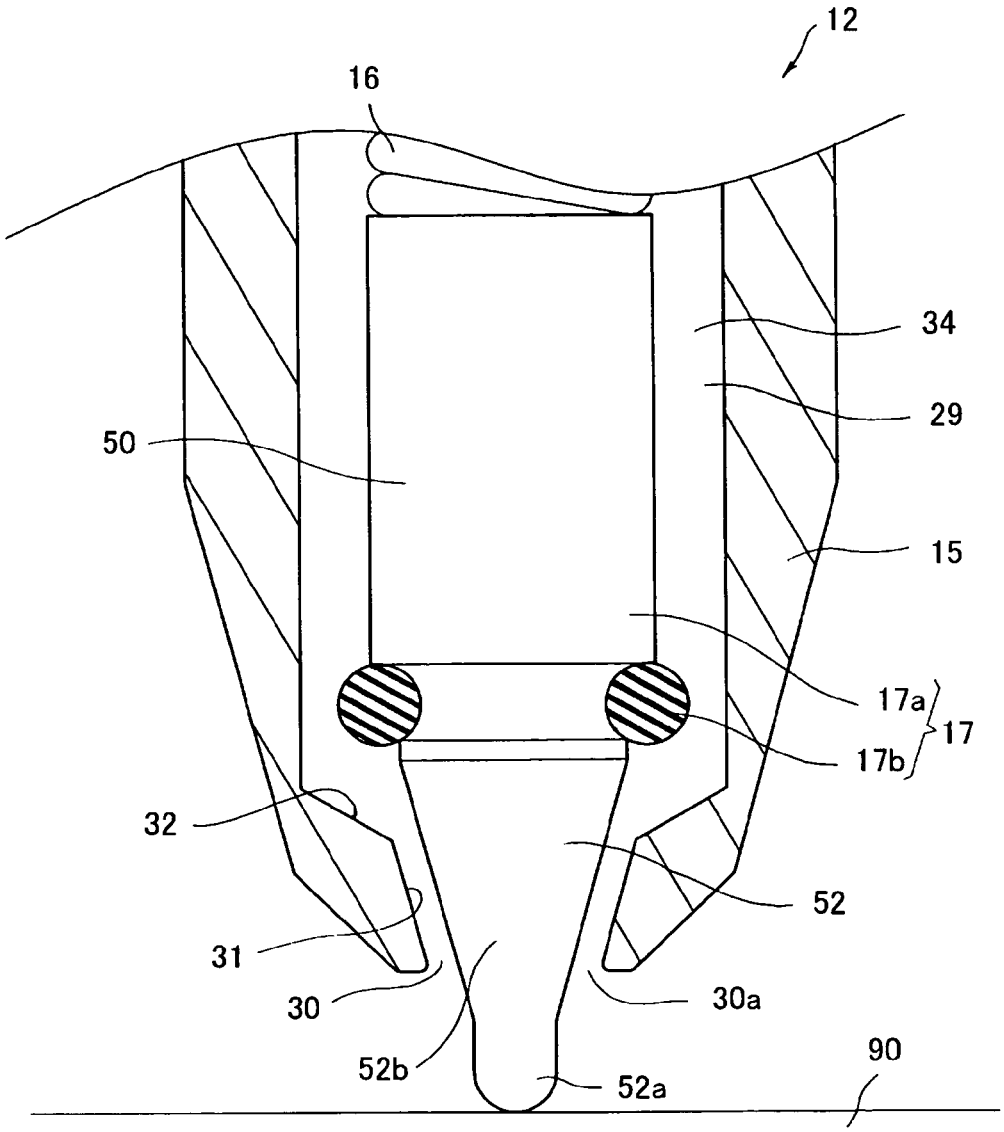
FIG. 7 is another enlarged cross section of the vicinity of the distal end of the tip unit for a liquid applicator in discharging application liquid.
Figure 8:
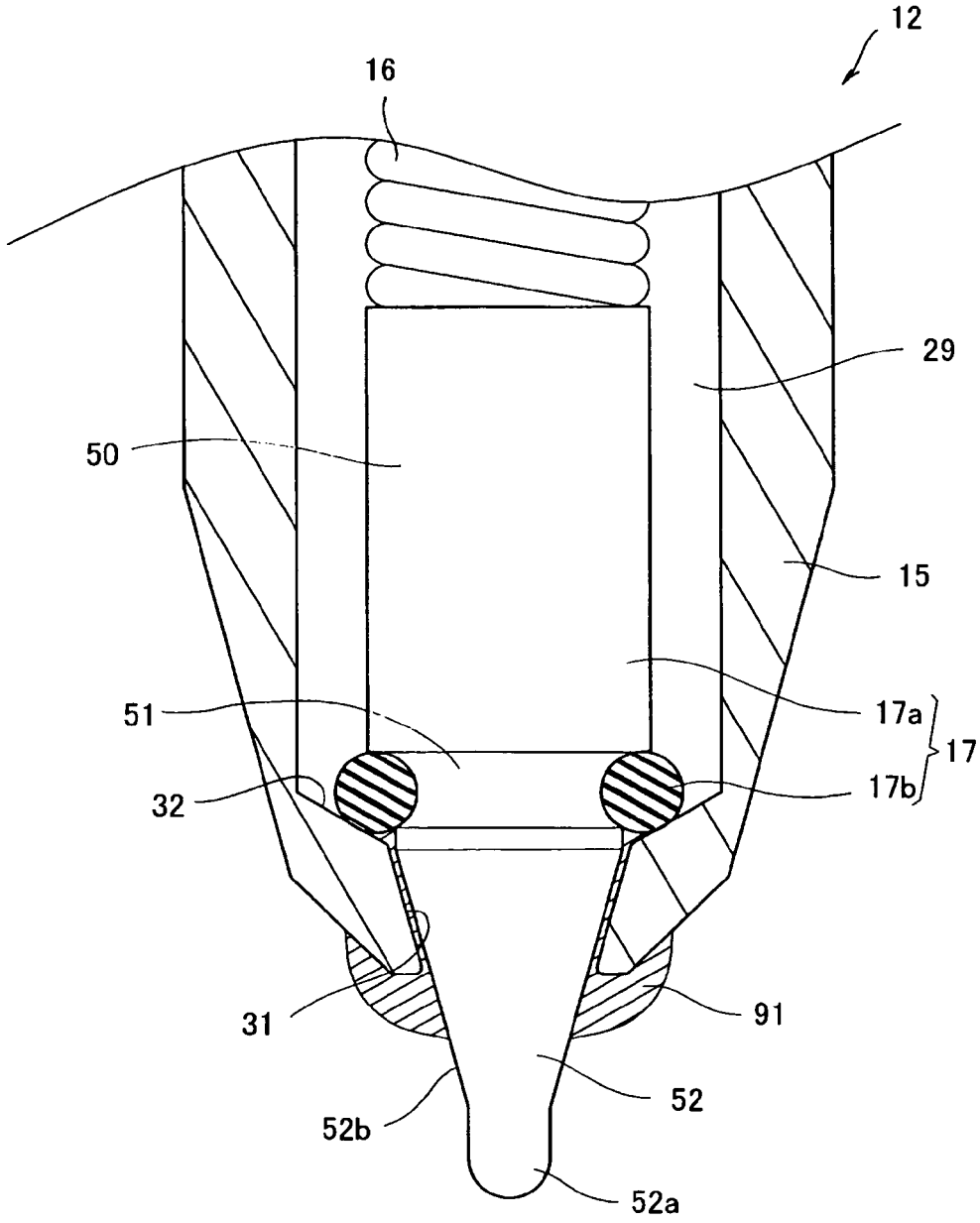
FIG. 8 is still another enlarged cross section of the vicinity of the distal end of the tip unit for a liquid applicator in the case that solid has adhered thereto.
Figure 9:
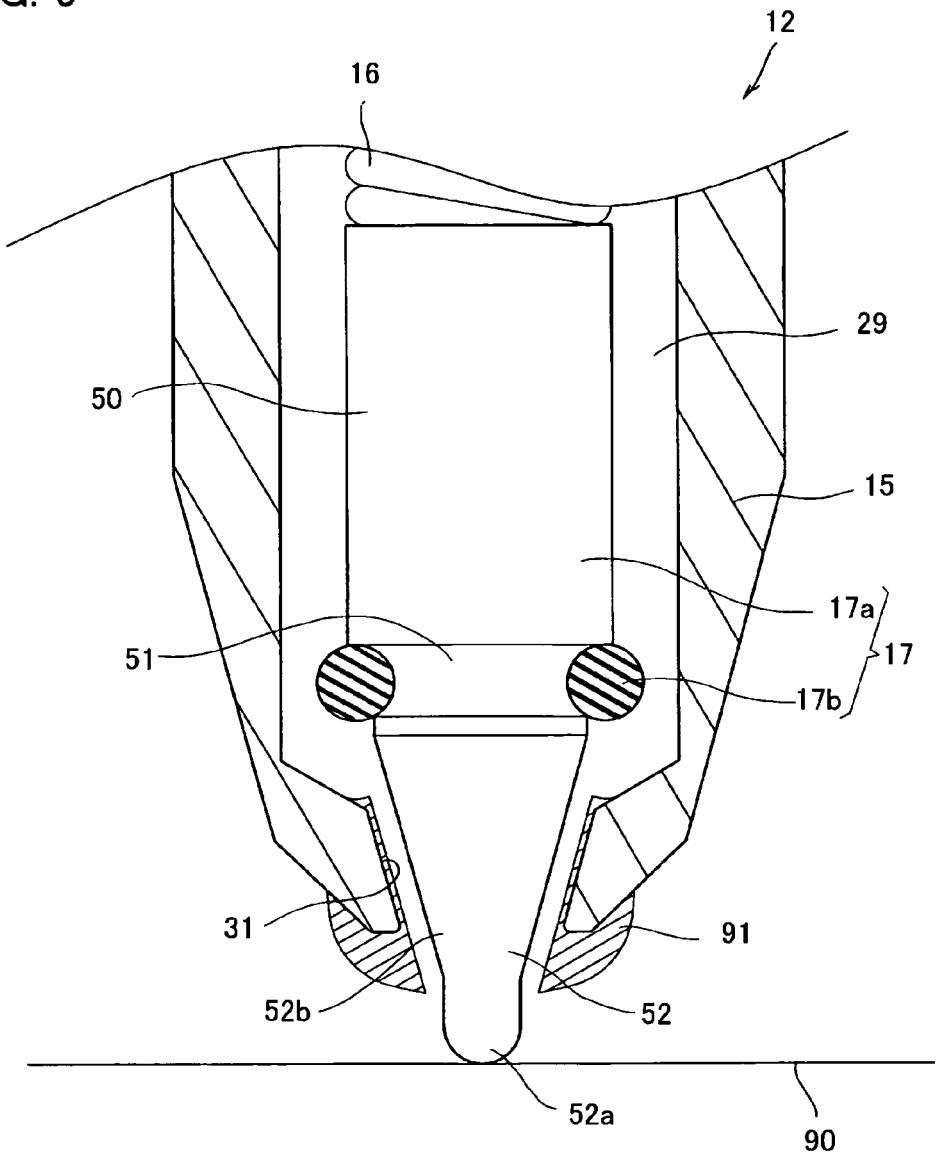
FIG. 9 is yet another enlarged cross section of the vicinity of the distal end of the tip unit for a liquid applicator in the case that solid has adhered thereto.
Figure 10A:
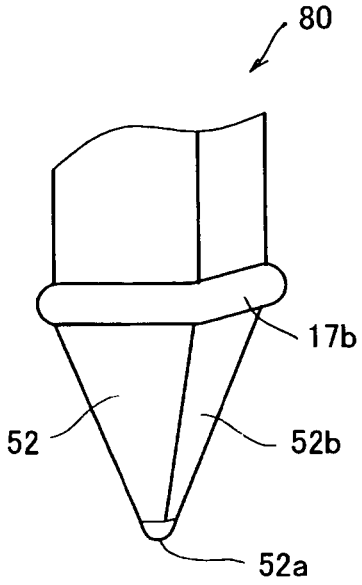
FIGS. 10A and 10B each are a perspective view of a modified embodiment of a tapered area.
Figure 10B:
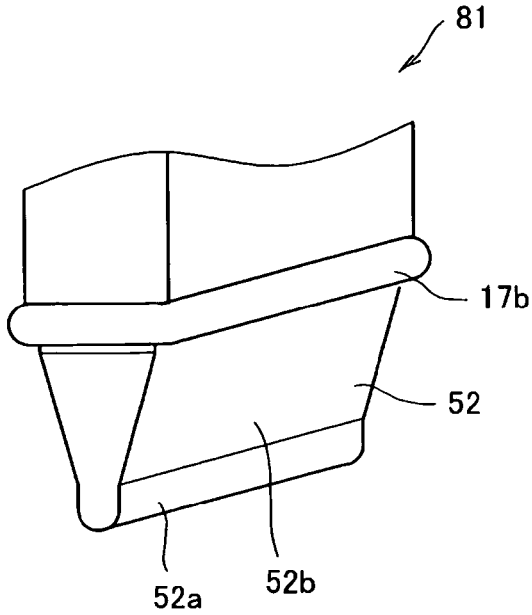

Now, embodiments of the present invention will be described in detail below, making reference to the accompanying drawings. FIGS. 1A, 1B, and 1C are diagrams showing a liquid applicator of the present invention: FIG. 1A being an elevation view thereof, FIG. 1B being a top view thereof, and FIG. 1C being a partial cross section thereof. FIG. 2 is an enlarged cross section of a vicinity of a distal end of the liquid applicator shown in FIG. 1. FIGS. 3A, 3B, and 3C are diagrams showing a tubular member: FIG. 3A being an elevation view thereof, FIG. 3B being a cross section thereof, and FIG. 3C being is an enlarged cross section of a vicinity of a distal end thereof. FIG. 4 is an elevation view of a biasing member. FIGS. 5A to 5D are diagrams showing a valve member: FIG. 5A being an elevation view of a main body; FIG. 5B being a bottom view of the main body; FIG. 5C being an elevation view of a ring, and FIG. 5D being a bottom view of the ring. FIG. 6 is an enlarged cross section of a vicinity of a distal end of a tip unit for a liquid applicator. FIG. 7 is another enlarged cross section of the vicinity of the distal end of the tip unit for a liquid applicator in discharging application liquid. FIG. 8 is still another enlarged cross section of the vicinity of the distal end of the tip unit for a liquid applicator in the case that solid has adhered thereto. FIG. 9 is yet another enlarged cross section of the vicinity of the distal end of the tip unit for a liquid applicator in the case that solid has adhered thereto. FIGS. 10A and 10B each are a perspective view of a modified embodiment of a tapered area.

A liquid applicator in a first embodiment of the present invention includes, as shown in FIGS. 1A, 1B, and 1C, an inner barrel 10, a head stopper (distal plug) 11, a tip unit 12 for a liquid applicator, an outer barrel 13, and a tail stopper (proximal plug) 14.

The inner barrel 10 is of a hollow cylindrical shape, and as shown in FIG. 1C, defines therein a reservoir 20 for an application liquid. When the liquid applicator 1 is used, the reservoir 20 is filled with application liquid. The application liquid is discharged through a distal opening portion 30 of the tip unit 12, so as to be applied.

The application liquid for use in the liquid applicator 1 of the present embodiment is correction fluid, which is used by being applied on writing such as letters written on a paper. Further, the correction fluid, which is the application liquid, is high viscous liquid of a gel type. Herein, the application liquid for use in the liquid applicator 1 can employ liquid other than the correction fluid.

The outer barrel 13 is of a hollow cylindrical shape and is located at the outer side of the inner barrel 10. The outer barrel 13 has a predetermined strength so as to protect the inner barrel 10 from being deformed even when a force is applied to the outer barrel 13 by being held in using. The tail stopper 14 is located at a proximal end of the outer barrel 13. The inner barrel 10 is used as a refill, with the reservoir 20 of the inner barrel 10 filled with application liquid, to which the head stopper 11 and the tip unit 12 attached. When the application liquid is finished up, the refill is changed, so that the outer barrel 13 and the tail stopper 14 are reused.

As shown in FIGS. 1A, 1B, and 1C, the head stopper 11 is located at a distal end of the inner barrel 10, and further, the tip unit 12 is located at a distal end of the head stopper 11.

The head stopper 11 is of a conical shape with a through-bore 21. The through-bore 21 penetrates through a central axis of the conical shape of the head stopper 11, and as shown in FIGS. 1A to 2, the tip unit 12 is inserted in the through-bore 21.

As shown in FIG. 2, the through-bore 21 has two steps 22 and 23 with their diameters increasing toward a distal end, the step 22 being located at a distal side of the step 23. Further, the through-bore 21 has a tip insertion portion 25 formed at a distal side of the step 22 and a small diameter portion 26 having an inner diameter smaller than that of the tip insertion portion 25 and formed between the steps 22 and 23.

The tip unit 12 for a liquid applicator includes a tubular member 15, a biasing member 16, and a valve member 17.

The tubular member 15 is, as shown in FIGS. 3A and 3B, of a hollow cylindrical shape and defines therein a through-bore 29. The through-bore 29 has a distal opening portion 30 at its distal end and a proximal opening portion 28 at its proximal end.

The tubular member 15 has an outer shape with the distal and the proximal ends slightly tapered.

The through-bore 29 has a central part with a substantially same inner diameter all the way through, a distal part adjacent to the distal opening portion 30 with an inner diameter gradually decreasing toward the distal end, and the proximal opening portion 28 at the proximal end with an inner diameter slightly larger than that of the central part.

Further, the through-bore 29 has a circularly-curved surface 34 at the central part. The distal part adjacent to the distal opening portion 30 has a first tapered surface 31 and a second tapered surface 32.

The first and the second tapered surfaces 31 and 32 are each of an inwardly-facing tapered (or conical) shape, with its diameter decreasing toward the distal end. The second tapered surface 32 has a distal end connecting to the first tapered surface 31 and a proximal end connecting to the circularly-curved surface 34.

The circularly-curved surface 34 has a same circular cross-sectional shape in a plane perpendicular to its axis at any position thereof, defining a space of a columnar shape. There is provided a large diameter portion 33 formed at a proximal end of the circularly-curved surface 34.

The tubular member 15 has a rotationally-symmetrical structure with an outer shape and an inner shape of a circular shape at any position when being cut in a plane perpendicular to its symmetric axis "L". A shape obtained by cutting the tubular member 15 in a plane including the symmetric axis "L" is shown in FIG. 3B.

Referring to FIG. 3C, the first tapered surface 31 has a taper angle "A1" of 30 degrees and the second tapered surface 32 has a taper angle "A2" of 120 degrees. The taper angle "A2" is larger than the taper angle "A1", so that a boundary between the first and the second tapered surfaces 31 and 32 projects inward. Herein, the taper angle "A1" of the first tapered surface 31 is preferably in a range within 10 to 120 degrees, whereas the taper angle "A2" of the second tapered surface 32 is preferably in a range within 60 to 140 degrees.

The biasing member 16 is a helical compression spring, and as shown in FIG. 4, consists of a small diameter winding portion 40, a tapered winding portion 41, a large diameter winding portion 45, and a protruding winding portion 46.

The large diameter winding portion 45 is composed of a biasing force generating portion 42 and a tight winding portion 43. The biasing force generating portion 42 has adjoining turns spaced from one another, so as to generate a biasing force when the biasing member 16 is compressed.

The tight winding portion 43 of the large diameter winding portion 45, the small diameter winding portion 40, the tapered winding portion 41, and the protruding winding portion 46 each have tight winding where adjoining turns are in close contact with each other.

The small diameter winding portion 40 has an outer diameter of a winding smaller than that of the large diameter winding portion 45 and has a distal portion 40*a* in contact with a proximal surface 48 of a main body 17*a* of the valve member 17.

The large diameter winding portion 45 has an outer diameter of a winding smaller than a diameter of the circularly-curved surface 34 of the through-bore 29. Further, as shown in FIG. 2, the small and large diameter winding portions 40 and 45 are located within the circularly-curved surface 34.

The tapered winding portion 41 is located between the small and the large diameter winding portions 40 and 45. The protruding winding portion 46 is located at a proximal side of the large diameter winding part 45 and has a part located at the outer side of the large diameter winding portion 45. The protruding winding portion 46 has an outer diameter smaller than an inner diameter of the small diameter portion 26 of the through-bore 21 of the head stopper 11 and is located within the small diameter portion 26.

Herein, the biasing member 16 may be another compression spring having a different configuration from the above-mentioned spring and may employ an alternate only if the valve member 17 is biased toward the distal end.

The valve member 17 consists of a main body 17*a* and a ring 17*b*.

The main body 17*a* of the valve member 17, as shown in FIGS. 5A and 5B, includes a columnar portion 50, a circumferential groove 51, and a tapered area 52.

More specifically, the main body 17*a* has a configuration formed by the columnar portion 50 and the tapered area 51 with a spring holding portion 17*c*, and further the circumferential groove 51 is formed at a boundary between the columnar portion 50 and the tapered area 51.

The columnar portion 50 has a columnar shape and is located at a proximal side of the tapered area 52. The columnar portion 50 has an outer diameter substantially equal to that of the small diameter winding portion 40 of the biasing member 16 and smaller than the inner diameter of the circularly-curved surface 34 of the tubular member 15. Specifically, the columnar portion 50 has the outer diameter of 0.8 mm.

The tapered area 52 has a conical shape and has an inclined surface 52*b* of a tapered shape and a rounded bulb-shaped tip 52*a* at a tip of the conical shape. The tapered area 52, as shown in FIG. 6, has a taper angle "B1" substantially equal to the taper angle "A1" of the first tapered surface 31 of the tubular member 15, so that the tapered area 52 of the valve member 17 and the first tapered surface 31 of the tubular member 15 have shapes capable of being brought into surface contact with each other. Thus, when the liquid applicator 1 is not used, it is possible to reduce a distance between the inclined surface 52*b* and the first tapered surface 31. When the valve member 17 is moved, it is easy to increase the distance.

Herein, even if the taper angle "B1" and the taper angle "A1" are not the same, but if a difference therebetween is 10 degrees or less, a gap between the tapered area 52 and the first tapered surface 31 is reduced when the applicator 1 is not used.

The tip 52*a* has a hemispherical shape and a size smaller than that of a distal opening 30*a* of the distal opening portion 30 of the tubular member 15.

The circumferential groove 51 is a concave portion located between the columnar portion 50 and the tapered area 52 and has a shape in conformity with that of the ring 17*b*. Specifically, the circumferential groove 51 circumferentially makes a circuit to form an annular shape. A shape obtained by cutting the groove 51 in a plane perpendicular to a circumference thereof is of a circular shape. The groove 51 has a curved surface and has a curvature substantially equal to that of a surface of the ring 17*b*.

The spring holding portion 17*c* is positioned at a proximal side of the columnar portion 50. The spring holding portion 17*c* is a round bar having an outer diameter smaller than an inner diameter of coil of the small diameter winding portion 40 at the distal end of the biasing member 16 (described in detail below), so as to be, as shown in FIG. 2, inserted into the biasing member 16. The biasing member 16 biases the columnar portion 50 toward a distal end of the valve member 17.

The ring 17*b* is an O-ring made of rubber and is arranged so as to be engaged with the circumferential groove 51 of the main body 17*a*. Further, the ring 17*b* is made of a material softer than the main body 17*a* and the tubular member 15, and more specifically, can be made of fluorine-containing rubber or NBR (acrylonitrilebutadiene rubber). Herein, the tubular member 15 and the main body 17*a* of the valve member 17 can be made of a material such as metal or resin.

Since the ring 17*b* is made of an elastic body, which is a material softer than the main body 17*a* and the tubular member 15, as described below, the ring 17*b* is pressed onto the second tapered surface 32 and is elastically deformed, thereby ensuring close contact of the second tapered surface 32 with the ring 17*b*. Further, the second tapered surface 32 has an inwardly-facing tapered shape in which its diameter decreases toward the distal end thereof. Thus, when the valve member 17 is pressed onto the second tapered surface 32 by the biasing member 16, a force inwardly acts on the ring 17*b*, so that the ring 17*b* is sandwiched between the second tapered surface 32 and a surface 51*a* bounding the circumferential groove 51. That achieves closer contact between the ring 17*b* and the circumferential groove 51 of the main body 17*a*. An axially facing portion 51*b* of the surface 51*a* squeezes the ring 17*b* against the axially oppositely facing second tapered surface 32.

The ring 17*b* has an outer diameter of 1.0 mm, an inner diameter of 0.6 mm, and a cross-sectional diameter of 0.2 mm.

Since the columnar portion 50 has the outer diameter of 0.8 mm, the ring 17*b* protrudes out of the columnar portion 50 when the ring 17*b* having the outer diameter of 1.0 mm is attached to the circumferential groove 51 so as to be engaged therewith. The ring 17*b* protrudes by 0.1 mm. The ring 17*b* preferably protrudes by a length in a range within 20 to 80% of the cross-sectional diameter of the ring 17*b*, and by a length of 50% in the present embodiment. Further, the ring 17*b* preferably protrudes by a length in a range within 5 to 30% of the outer diameter of the columnar portion 50, and by a length of 12.5% in the present embodiment.

The ring 17*b* protrudes by the length as described above, thereby ensuring close contact of the ring 17*b* with the second tapered surface 32.

The tip unit 12 is, as shown in FIG. 2, manufactured by inserting the valve member 17, which is composed of the ring 17*b* attached to the main body 17*a*, and the biasing member 16 into the through-bore 29 of the tubular member 15. The valve member 17 is arranged at a distal end of the tip unit 12 with the tip 52*a* of the valve member 17 exposed out of the distal opening 30*a* of the tubular member 15 and with the protruding winding portion 46 exposed out of the proximal opening portion 28 of the tubular member 15.

Further, the tip unit 12 is inserted into the tip insertion portion 25 of the head stopper 11. This insertion is arranged so that the proximal opening portion 28 of the tubular member 15 and the biasing member 16 come to rearward of the stopper 11. After insertion of the tip unit 12 into the stopper 11, the protruding winding portion 46 is brought into contact with the step 23 of the stopper 11, so that the biasing member 16 is compressed between the step 23 and the proximal surface 48 of the valve member 17. Further, the tapered area 52 of the valve member 17 is brought into contact with the first tapered surface 31 and the ring 17*b* is brought into contact with the second tapered surface 32.

FIG. 6 shows the tip unit 12 inserted in the head stopper 11 on an enlarged scale. The valve member 17 seals the distal end of the through-bore 29 of the tip unit 12. In the present embodiment, a biasing force applied by the biasing member 16 makes the valve member 17 to be pressed onto and in contact with the tubular member 15.

Specifically, the ring 17*b* has contact with the second tapered surface 32 annularly. Since being made of an elastic body, which is a soft material, the ring 17*b* is elastically deformed depending on its pressed conditions, thereby achieving closer contact. Further, depending on conditions between the tapered area 52 of the valve member 17 and the first tapered surface 31, deformability can be changed so as to maintain close contact. More specifically, as shown in FIG. 8, even when a distance between the tapered area 52 of the valve member 17 and the first tapered surface 31 increases because of solid 91, which is a solidified product of application liquid, lying therebetween, the ring 17*b* is closely in contact with the second tapered surface 32, thereby ensuring sealing of the distal end of the through-bore 29 by the valve member 17.

Herein, it is possible to allow a surface contact of the tapered area 52 with the first tapered surface 31 with the ring 17*b* deformed and closely contacting with the second tapered surface 32, and in this case, such contacts at two positions are enabled.

Consequently, the distal end of the through-bore 29 of the tubular member 15 is normally sealed, so that an application liquid filled in the reservoir 20 within the inner barrel 10 seldom leaks out of the distal end and dries. Further, even with a relatively small biasing force applied by the biasing member 16, sealing is achieved without fail, thereby lessening a force to be pressed onto an object 90, onto which the liquid is applied, in applying the liquid.

In order to discharge the application liquid in using the liquid applicator 1, as shown in FIG. 7, the tip 52*a* is pressed onto the object 90.

When the tip 52*a* is pressed onto the object 90 with a force larger than the biasing force of the biasing member 16, the biasing member 16 is compressed, so that the valve member 17 is moved toward the proximal end. That generates a gap between the tapered area 52 of the valve member 17 and the first tapered surface 31 and another gap between the ring 17*b* and the second tapered surface 32, which release sealing of the distal end.

At this time, a distance of relative movement of the valve member 17 to the tip 52*a* changes a size of the gap between the tapered area 52 and the first tapered surface 31. Therefore, increasing of the distance of relative movement of the valve member 17 with the tip 52*a* pressed onto the object 90 by a large force enables application of a large quantity of the liquid, thereby facilitating adjustment of application quantity.

Then, upon releasing of sealing of the distal end of the through-bore 29 of the tubular member 15, the application liquid filled in the reservoir 20 is discharged through the through-bore 21 of the head stopper 11, the through-bore 29 of the tubular member 15 of the tip unit 12, and the distal opening portion 30.

The tip 52*a* is taken off the object 90 so as to stop discharging of the liquid. Upon taking the tip 52*a* off the object, a biasing force of the biasing member 16 moves the valve member 17 toward the distal end, thereby sealing the distal end again.

Herein, while the applicator 1 is used, solidified liquid might be adhered to the tubular member 15 or the valve member 17. As shown in FIG. 8, such solid 91, which is the solidified liquid, is normally adhered to the outer side of the sealed part, that is, the outer side of a part where the ring 17*b* is in contact with the second tapered surface 32. Even in such a case, as shown in FIG. 9, pressing the tip 52*a* generates a gap between the solid 91 and the tapered area 52, so that the liquid is applied.

Specifically, since an inner surface of the solid 91 has a tapered shape, movement of the valve member 17 toward the proximal end ensures a gap between the solid 91 and the valve member 17, so that the liquid is applied.

Further, even if such solid 91 is adhered to between the first tapered surface 31 and the tapered area 52 and a distance therebetween is increased, the ring 17*b* and the second tapered surface 32 have close contact with each other and seal the distal end, so that the liquid seldom leaks or dries.

In this way, by the liquid applicator 1 of the present embodiment, the valve member 17 ensures sealing of the distal opening portion 30 when the applicator 1 is not used for application of liquid, thereby preventing the liquid from drying or leaking even without sealing by a cap.

Thus, the application liquid can employ a highly-volatile solvent, such as methylene chloride, pentanes, hexanes, and heptanes.

The application liquid used for the present invention is not limited, but can employ the following kind.

The application liquid can use an organic solvent capable of achieving resin solubility and drying property of coating. A hydrocarbon solvent such as an aliphatic hydrocarbon solvent, an alicyclic hydrocarbon solvent, an aromatic hydrocarbon solvent, and a halogenated hydrocarbon solvent can be used. A polar solvent including an alcohol solvent such as methanol, ethanol, and propanol, a ketone solvent such as methyl ethyl ketone and isobutyl methyl ketone, and an ether alcohol solvent such as propylene glycol monomethyl ether and propylene glycol dimethyl ether also can be used.

It is possible to add a gelling agent to the application liquid. If so, a dispersant gelling agent such as bentonite can be used, but the agent used in this application liquid should have interfacial activity whereby the agent is partially solved in an organic solvent, form a three-dimensional network (gel structure) in ink, introduce a colorant into the three-dimensional network (gel structure), and lower its viscosity by shear force in application.

The gelling agent having interfacial activity includes a specific metal soap for instance, but the gelling agent used in the application liquid is a soluble gelling agent especially having solubility (20 degrees centigrade) of 0.1 to 20% by weight in an organic solvent. Specifically, the gelling agent used herein should have a molecular structure incorporating polar groups and nonpolar groups so as to exhibit solubility (20 degrees centigrade) of 0.1 to 20% by weight in an organic solvent and to give pseudo-plastic flowability to ink. Such gelling agent probably has a three-dimensional structure that introduces colorants such as pigment particles into micelle structures so as to disperse and stabilize the colorants with high viscosity. Addition of a shear force to ink in application makes the agent to have a lower viscosity and to be fluidized, thereby exerting a leveling effect and a writing performance.

The above-mentioned soluble gelling agent includes aluminum 2-ethylhexanoate for instance. As an organic solvent for an oil-based ink composition containing such the gelling agent, it is suitable to use a hydrocarbon solvent such as an aliphatic hydrocarbon solvent, an alicyclic hydrocarbon solvent, an aromatic hydrocarbon solvent, and a halogenated hydrocarbon solvent. That is because such the hydrocarbon solvent is easy to form a three-dimensional network (gel structure) and has a sufficient deterrent effect on precipitation separation of a colorant.

In the case of an oil-based ink composition containing a soluble gelling agent such as aluminum 2-ethylhexanoate, in view of a drying property and an insoluble property of writing (i.e., a degree where a written line is hardly soluble in the solvent), cyclohexane, methylcyclohexane, ethylcyclohexane, or cyclopentane among alicyclic hydrocarbon solvents is especially suitable for a solvent as a correction fluid. More importantly, such the solvent simultaneously has an effect of providing an environment conductive to form a three-dimensional network (gel structure) to a soluble gelling agent such as aluminum 2-ethylhexanoate. Alternately, the same can be said to an aliphatic hydrocarbon solvent, especially iso-heptane, n-heptane, iso-octane, or n-octane.

A colorant may be added to the application liquid. The colorant does not limit to a specific kind. Various kinds of white and/or color pigments can be used. Specifically, such pigments include an inorganic pigment, an organic pigment, a resin particle pigment, a fluorescent pigment, a luster pigment, a photoluminescent pigment, and a dichroic pigment. An inorganic pigment and an organic pigment include titanium dioxide, aluminum powder, brass powder, an alkylenebismelamine, a copper phthalocyanine pigment, a threne pigment, an azo pigment, a quinacridone pigment, an anthraquinone pigment, a dioxazine pigment, an indigo pigment, a thioindigo pigment, a perynone pigment, a perylene pigment, an isoindolinone pigment, and an azomethine pigment. A fluorescent pigment includes a glass flake pigment and a metal-coated pigment. A resin particle pigment can be colored by a pigment or a dye. Alternately, a dye such as a direct dye, an acid dye, and a basic dye can be used as the colorant. These colorants may be used alone or by mixture.

A colorant for the application liquid used for the present invention, especially titanium dioxide, is preferably contained by 20 to 60% by weight in an ink compound. In particular, as for a correction fluid, a colorant to be a concealing agent is preferably contained by 30 to 60% by weight in a total amount of ink from a practical point of view, and most preferably by 35 to 55% by weight therein. The colorant contained by less than 30% by weight therein makes difficult to have a sufficient concealing effect. The colorant contained by more than 60% by weight therein makes the liquid too thick, resulting in decreasing of coating properties and a writing performance. A colorant other than titanium dioxide can be contained by an appropriate amount according to usage.

The application liquid used for the present invention can employ a resin, besides phenolic resin, that exerts a solubility in an organic solvent, a film formation property, an adhesion property onto a coating surface (writing surface), and/or a dispersibility into a colorant, that is, a known resin such as a film-forming resin and a dispersed resin, having a compatibility with a soluble gelling agent such as aluminum 2-ethylhexanoate. That includes rosin modified resin, alkyd resin, acrylic resin, unsaturated thermoplastic elastomer resin, saturated thermoplastic elastomer resin, vinyl alkyl ether resin, cyclized rubber, petroleum resin, and terpene resin. These resins are appropriately selected and used depending on a required coating property and can be used alone or by mixing more than one kind thereof.

The main body 17*a* of the valve member 17 of the above-mentioned embodiment is provided with the tapered area 52 of a conical shape, but may be provided with another member of another shape only if the member has the inclined surface 52*b*. It is possible to employ, for example, a valve member 80 shown in FIG. 10A or a valve member 81 shown in FIG. 10B. The valve member 80 has a tapered area 52 of a multi-sided pyramid shape. The valve member 81 has a tapered area 52 having a substantially same cross-sectional shape in a plane perpendicular to a width direction and two opposed inclined surfaces 52*b* of a flat shape.

Further, the tip 52*a* of the main body 17*a* may be of a shape other than a spherical shape, such as a cannonball shape, a conical shape, a three-sided pyramid, and a four-sided pyramid.

The invention claimed is:

1. A liquid applicator, comprising:

a tip unit for a liquid applicator comprising a tubular member having therein a through-bore with an axis and a valve member arranged within and being movable in the through-bore, the through-bore having a distal opening and a proximal opening, wherein the tubular member and the valve member each has a proximal end and a distal end, wherein the valve member is accompanied with a biasing member, so as to be biased toward the distal end of the tubular member to be in close contact with and to seal the distal opening, with part of the valve member protruding from the distal opening of the through-bore, wherein the liquid applicator has a reservoir for containing an application liquid, the reservoir being communicated with the proximal opening of the through-bore of the tubular member, so that the application liquid is applied to an object by pressing the part of the valve member protruding from the distal opening against the object to move the valve member back so as to release sealing of the distal opening, wherein the distal opening has a first tapered surface and a second tapered surface formed at a proximal side of the first tapered surface, the first and the second surfaces each being of an inwardly-facing tapered shape with its diameter decreasing toward the distal end, the second tapered surface having a taper angle larger than that of the first tapered surface, and wherein the valve member comprises a main body having a tapered area with an inclined surface over a first axial extent and an elastically deformable ring located at a proximal side of the tapered area, the ring and the second tapered surface being in close contact with each other and the ring elastically deformed so as to seal the distal opening, wherein the tapered area has a taper angle having a difference of 10 degrees or less from the taper angle of the first tapered surface of the tubular member, so that there is not a large gap over an axial distance that the tapered area and first tapered surface coincide, wherein the main body has a circumferential groove and the ring is a discrete component joined to the main body by being engaged within the circumferential groove, wherein the ring is sandwiched between a surface bounding the circumferential groove and the second tapered surface, wherein the main body does not directly contact the second tapered surface.

2. The liquid applicator according to claim 1, wherein the tapered area is conical in shape.

3. The liquid applicator according to claim 1, wherein the tapered area has a taper angle substantially equal to the taper angle of the first tapered surface of the tubular member.

4. The liquid applicator according to claim 1, wherein the circumferential groove has a shape conformed to a shape of an inner side of the ring.

5. The liquid applicator according to claim 1, wherein the ring has a changing degree of deformation in response to a distance between the first tapered surface and the inclined surface of the tapered area.

6. The liquid applicator according to claim 1, wherein the biasing member is a helical compression spring, and wherein the valve member has a spring holding part having an outer diameter smaller than an inner diameter of coil of the biasing member at the proximal end of the valve member, so that the biasing member is positioned at the proximal end of the main body of the valve member with the spring holding part inserted in the biasing member.

7. The liquid applicator according to claim 1, wherein the taper angle of the first tapered surface is in a range within 10 to 120 degrees.

8. The liquid applicator according to claim 1 wherein the ring is elastically deformed by being pressed onto the second tapered surface.

9. The liquid applicator according to claim 1 wherein the ring is made from a material that is softer than a material from which the main body is made.

10. The liquid applicator according to claim 1 wherein the ring is an O-ring made of rubber.

11. The liquid applicator according to claim 1 wherein the surface bounding the circumferential groove has an axially facing portion that squeezes the ring and deforms the ring against the second tapered surface.

* * * * *